United States Patent [19]

Bialczak et al.

[11] Patent Number: 4,495,269

[45] Date of Patent: Jan. 22, 1985

[54] WATERBORNE TWO COMPONENT DIAZO TYPE COATING COMPOSITION WITH HYDROLYZED POLYVINYL ACETATE AND HEXAMETHOXY METHYLMELAMINE RESIN

[75] Inventors: Edward C. Bialczak, Guilford; John J. Chernovitz, East Haven, both of Conn.

[73] Assignee: AM International, Inc., Chicago, Ill.

[21] Appl. No.: 642,706

[22] Filed: Aug. 20, 1984

Related U.S. Application Data

[63] Continuation of Ser. No. 421,514, Sep. 22, 1982, abandoned.

[51] Int. Cl.[3] ..... G03C 1/60; G03C 5/34

[52] U.S. Cl. ..... 430/150; 430/148; 430/169; 430/176; 430/179

[58] Field of Search ..... 430/169, 176, 148, 146, 430/150, 179

[56] References Cited

U.S. PATENT DOCUMENTS

| | | | |
|---|---|---|---|
| 2,405,523 | 8/1946 | Sease et al. | 430/176 |
| 2,822,271 | 2/1958 | Krieger | 430/176 |
| 2,822,272 | 2/1958 | Kosalek et al. | 430/176 |
| 3,100,150 | 8/1963 | Chismar et al. | 430/270 |
| 3,353,984 | 11/1967 | Landau | 430/169 |
| 4,275,137 | 6/1981 | Verhoof | 430/160 |
| 4,471,043 | 9/1984 | Van de Vorle | 430/176 |

FOREIGN PATENT DOCUMENTS

| | | | |
|---|---|---|---|
| 702294 | 1/1954 | United Kingdom | 430/176 |
| 1169227 | 10/1969 | United Kingdom | 430/176 |

OTHER PUBLICATIONS

Anon, "Cymel 303", Proprietary Literature from American Cyanamide.

*Primary Examiner*—Charles L. Bowers, Jr.
*Attorney, Agent, or Firm*—Nicholas A. Camasto; Donald C. Kolasch

[57] ABSTRACT

An aqueous diazo coating composition is disclosed to be used in accordance with an alkaline vapor development system, containing a hydrolyzed resin together with a diazo light-sensitive compound, coupling agent and stabilizing materials. The aqueous diazo coating composition of the present invention provides a method of fabricating a light-sensitive diazo member for use in combination with a development system utilizing alkaline vapors which excludes the use of organic solvents.

7 Claims, No Drawings

WATERBORNE TWO COMPONENT DIAZO TYPE COATING COMPOSITION WITH HYDROLYZED POLYVINYL ACETATE AND HEXAMETHOXY METHYLMELAMINE RESIN

This application is a continuation of application Ser. No. 421,514 filed on Sept. 22, 1982, abandoned.

BACKGROUND OF THE INVENTION

The present invention relates to a diazo imaging process and, more specifically, to a two-component aqueous diazo imaging composition and method of preparing a diazo imaging member.

In reprographic methods for forming a dye image utilizing a light-sensitive diazonium compound, the diazo composition is selectively exposed to actinic radiation, decomposing the diazonium molecules in the light struck areas to produce a relatively colorless area which is inactive during further processing. The light-sensitive diazonium compound remaining in the unexposed areas is subjected to a coupling reaction with a compound referred to as a coupler capable of reacting with the diazonium compound in an alkaline environment to form a dye image selectively in the reprographic material. The two most widely accepted diazo processes are often referred to as the one-component or semi-moist development process, wherein the light-sensitive diazo type material contains the diazo compound in the absence of a coupler, and the development step entails applying a developer solution containing a coupler to the radiation-exposed diazo composition, and a two-component or dry development process wherein the light-sensitive diazo composition contains the diazo compound and the coupling component or components in an acidic environment, which protects against pre-exposure coupling, wherein the development step following actinic radiation exposure entails exposing the diazo-type material to an alkaline atmosphere of ammonia or amine vapors.

Although the two-component or dry development process has certain advantages over the one-component or semi-moist development process, the major advantage being the fact that it is essentially a dry process, there are certain disadvantages associated with the dry process. Heretofore, in the preparation of the diazo imaging member, the diazo composition has been coated onto a pretreated film base from an organic solvent system to produce the diazo copy member to be used in a conventional dry diazo imaging process. The use of organic solvents in the coating of the diazo member, however, has not only proved to be costly but the use of the solvents present safety hazards and have a negative impact upon the environment such that elaborate solvent recovery systems must be utilized taking into consideration serious environmental constraints with respect to waste disposal. Thus, not only is the solvent system expensive, but the solvent itself must be recovered from gases expelled from a dryer present in the system and then must be disposed of by environmentally accepted procedures. The solvents used also require special storage facilities.

SUMMARY OF THE INVENTION

Therefore, it is an object of the present invention to provide a diazo imaging system which will overcome the above-noted and other disadvantages.

It is a further object of the present invention to provide an aqueous diazo coating composition which will replace the presently used organic solvent systems, thus eliminating the many disadvantages inherent in the use of such solvent systems.

A further object of the present invention is to provide a waterborne diazo coating composition compatible with an underlying oleophilic support member.

Yet, still a further object of the present invention is to provide a novel method for preparing a diazo imaging member utilizing an aqueous diazo coating composition.

Still a further object of the present invention is to provide a diazo imaging process utilizing a diazo imaging system and member prepared from a waterborne diazo coating composition.

Another object of the present invention is to provide a two-component aqueous diazo coating composition to be utilized in a dry development process of an alkaline vapor environment.

The foregoing objects and others are accomplished in accordance with the present invention, generally speaking, by providing an aqueous-base diazo light-sensitive composition comprising a hydrolyzed resin, such as polyvinyl acetate, to fabricate a light-sensitive member to be used in a dry diazo imaging process. The composition of the present invention further includes, in addition to a diazo compound, at least one coupling agent for the diazonium component in a stabilized acidic environment. The resulting aqueous diazo formulation is coated onto a suitable support substrate, such as a standardized polymeric film substrate, with the resulting diazo coating being selectively exposed to ultraviolet radiation so as to decompose the diazonium molecules in an imagewise manner. The exposed surface is then introduced into an alkaline vapor environment wherein a coupling reaction takes place to produce a visible dye image.

It has been determined in the course of the present invention that, when utilizing a waterborne diazo composition as herein defined, a diazo imaging member can be expediently prepared which eliminates the use of expensive and environmentally hazardous organic solvent carriers. In accordance with the present invention, the resulting diazo coating composition is readily developed by the application of a mild neutralizing alkali, such as ammonia vapors, following selective exposure to UV radiation, to produce a diazo image. Contributing to the overall utility of the waterborne system is the presence of a hydrolyzed resin, such as polyvinyl acetate, which enhances the binding properties of the diazo components in the formulation. Diazo formulations to be commercially useful following coating on a particular substrate contain divalent acid additives to function as stabilizers to prevent pre-exposure coupling, thereby extending the commercial shelf life of the diazo product. The hydrolyzed polyvinyl acetate resin has been found to be completely compatible with the divalent acids present in the composition along with the diazo compound.

DETAILED DESCRIPTION OF THE INVENTION

In accordance with the present invention, there is provided an aqueous diazo imaging composition which includes, in addition to a light-sensitive diazo compound, the required coupling agents and necessary stablizing acids which are present to prevent pre-exposure coupling, thus providing the required commercial shelf life of the diazo composition. Inclusive in the diazo imaging composition is a hydrolyzed resin, such as polyvinyl acetate, which is completely compatible with the stabilizing divalent acids and the diazonium compound present, thus providing an expedient waterborne system for fabricating the light-sensitive member. It has been determined that the range of the hydrolysis of the resin additive can generally be from 18 to 90 percent, with it generally being preferred that the hydrolysis be in the range of 30 to 50 percent in order to achieve the most desirable results. Optimum results are realized when the resin is 30 or 40 percent hydrolyzed. The resulting light-sensitive composition has been found to be suitably compatible with the conventional hydrophobic substrates used as the support member for the film.

In formulating the composition of the present invention, any suitable diazo compound may be used which is compatible with the instant imaging process. Typical diazo compounds include 2,5-diethoxy-4-morpholino benzene diazonium zinc chloride, 2,5-diethoxy-4-o-tolylmercapto benzene diazonium chloride, 2,5-dimethoxy-4-o-tolylmercapto benzene diazonium chloride and 4-dimethyl amino-3-(p-chlorophenoxy)-6-chlorobenzene diazonium chlorozincate. The hydrolyzed homopolymer component of the diazo imaging composition of the present invention may be present in the light-sensitive composition in an amount ranging from about 2 to 8 percent. Any suitable resin additive which enhances the binding properties of the diazo composition may be utilized to practice the present invention. Typical resins include polyvinyl acetate, polyvinyl acetate-alcohol and polyacrylic resins.

The diazo formulation of the present invention is thoroughly blended by conventional techniques and coated on the surface of a substrate to a thickness of from about 15 to 50 microns. Any suitable substrate may be used, such as matte-surfaced copy paper, polyester film, such as Mylar (polyethylene terephthalate), polyvinyl chloride, polyethylene and polytetrafluoroethylene.

The stabilizing acids and coupler agents, as well as other agents added for controlling the coating rheology of the light-sensitive composition, are as those conventionally used in the art such as set forth in the publication *Photosensitive Diazo Compounds* by M. S. Dinaburg, 1964.

PREFERRED EMBODIMENTS

To further define the specifics of the present invention, the following examples are intended to illustrate and not limit the particulars of the present invention. Parts and percentages are by weight unless otherwise indicated. The examples are intended to illustrate various preferred embodiments of the present invention.

EXAMPLE 1

Example 1: The following formulation is dispersed in a Waring Blender for about 2 minutes.

| Formulation A | |
|---|---|
| Water | 100.0 cc |
| Hydroxyethyl cellulose | 2.25 gm |
| Tributyl phosphate | 0.7 gm |
| Trihydroxy diphenyl | 3.0 gm |
| Polyvinyl acetate (40% hydrolyzed) | 11.0 gm |
| Zeothix 95 | 1.75 gm |
| Thiourea | 1.0 gm |
| Paratoluene sulfonic acid | 0.5 gm |

-continued

| Formulation A | |
|---|---|
| Stannic Chloride pentahydrate | 0.8 gm |
| Diresorcyl sulfide | 1.5 gm |
| Cymel 303 | 2.0 gm |
| 2,5-diethoxy-4 morpholino, benzene diazonium zinc chloride | 3.0 gm |

Cymel 303 - A hexamethoxy methylmelamine resin commercially available from American Cyanamid.
Zeothex - A silica composition commercially available from J. M. Huber Co.

After blending, the solution is applied and coated onto a 3-mil polyester film by a conventional Myer Bar coating technique using a No. 18 bar, to a thickness of 25 microns. The film is dried and exposed under an engineering drafting line original in a Bruning 820 ammonia-type process diazo machine. The image produced is brown in color.

EXAMPLE 2

Example 2: The process of Example 1 is repeated with the substitution of the following formulation.

| Formulation B | |
|---|---|
| Water | 100.0 gm |
| Hydroxyethyl cellulose | 2.25 gms |
| Tributyl phosphate | 0.7 gms |
| Trihydroxy diphenyl | 3.0 gms |
| Polyvinyl acetate (40% hydrolyzed) | 11.0 gms |
| Zeothix 95 | 1.75 gms |
| Thiourea | 1.0 gm |
| Paratoluene sulfonic acid | 0.5 gm |
| Stannic Chloride pentahydrate | 0.8 gm |
| Diresorcyl sulfide | 0.9 gm |
| N($N^1$—morpholino-gamma propyl)-1-hydroxy-2-naphthamide | 0.6 gm |
| Cymel 303 | 2.0 gms |
| 2.5 diethyxy-4-morpholino, benzene diazonium zinc chloride | 3.0 gms |

As a result of the exposure and development steps a, black diazo image is obtained.

Although the present examples were specific in terms of conditions and materials used, any of the above-listed typical materials may be substituted where suitable in the above examples with similar results being obtained. In addition to the steps used to carry out the process of the present invention, other steps and modifications may be used if desirable. In addition, other materials may be incorporated into the formulation of the present invention which will enhance, synergize or otherwise desirably affect the properties of the diazo composition for its present use.

Those skilled in the art will have other modifications occur to them based on the teachings of the present invention. These modifications are intended to be encompassed within the scope of the present invention.

What is claimed is:

1. An aqueous diazo light-sensitive composition which comprises water, a 30 to 50% hydrolyzed polyvinyl acetate resin, hexamethoxy methylmelamine resin, a diazo light-sensitive compound and at least one coupling agent for said diazo compound together with at least one acid stabilizer to enhance the shelf life of said composition said composition substantially excluding the presence of organic solvents.

2. The composition of claim 1, wherein said polyvinyl acetate is 40 percent hydrolyzed.

3. A method of forming a diazo image which comprises applying an aqueous diazo light-sensitive film coating to the surface of a support substrate which substantially excludes the presence of organic solvents, said coating comprising a diazo light-sensitive compound, a 30 to 50% hydrolyzed polyvinyl acetate resin, hexamethoxy methylmelamine resin, a coupling agent and stabilizer for said diazo composition, drying said film, exposing said diazo composition selectively to ultraviolet radiation and developing said exposed diazo film to an alkaline vapor to produce a diazo image.

4. The process of claim 3, wherein said resin is 40 percent hydrolyzed.

5. The process of claim 3, wherein the film of said light-sensitive diazo composition is coated to a thickness of from 15 to 50 microns.

6. The process of claim 3, wherein said alkaline vapor comprises ammonia vapors.

7. The process of claim 3, wherein said alkaline vapor comprises amine vapors.

* * * * *